US007114988B2

(12) United States Patent
Sato et al.

(10) Patent No.: US 7,114,988 B2
(45) Date of Patent: Oct. 3, 2006

(54) CONNECTOR FOR CONNECTING A FLAT CABLE AND FOR SECURELY RETAINING THE SAME

(75) Inventors: Kazuomi Sato, Tokorozawa (JP); Masahiro Yamauchi, Tokyo (JP)

(73) Assignees: Japan Aviation Electronics Industry, Limited, Tokyo (JP); NEC Corporation, Tokyo (JP)

( * ) Notice: Subject to any disclaimer, the term of this patent is extended or adjusted under 35 U.S.C. 154(b) by 0 days.

(21) Appl. No.: 10/490,667

(22) PCT Filed: Sep. 26, 2001

(86) PCT No.: PCT/JP01/08363

§ 371 (c)(1),
(2), (4) Date: Jun. 28, 2004

(87) PCT Pub. No.: WO03/032444

PCT Pub. Date: Apr. 17, 2003

(65) Prior Publication Data

US 2004/0235339 A1 Nov. 25, 2004

(30) Foreign Application Priority Data

Aug. 22, 2000 (JP) ..... 2000/250924

(51) Int. Cl.
*H01R 12/24* (2006.01)

(52) U.S. Cl. ..... 439/492

(58) Field of Classification Search ..... 439/492, 439/493, 494, 495, 496, 497, 499
See application file for complete search history.

(56) References Cited

U.S. PATENT DOCUMENTS 4,415,216 A 11/1983 Narozny
4,749,371 A * 6/1988 Hirai et al. ..... 439/497
4,880,388 A 11/1989 Beamenderfer et al.
5,272,807 A 12/1993 Henschen et al.
5,433,632 A 7/1995 Cherney et al.
6,165,007 A 12/2000 Higuchi et al.
6,217,344 B1 4/2001 Saito et al.
6,824,408 B1 * 11/2004 Wu ..... 439/160

FOREIGN PATENT DOCUMENTS

| | | |
|---|---|---|
| DE | 8205 718 Y | 7/1982 |
| EP | 1003245 | 5/2000 |
| EP | 1041682 | 10/2000 |
| JP | 57157472 | 9/1982 |

(Continued)

OTHER PUBLICATIONS

Supplementary European Search Report.

*Primary Examiner*—Chandrika Prasad
(74) *Attorney, Agent, or Firm*—Collard & Roe, P.C.

(57) ABSTRACT

Having conductive contacts (4), a first insulator (1) retaining the contacts, and a cable-side insulator, attachable/detachable relative to the first insulator, for retaining a flat cable (6). The cable-side insulator includes a second insulator (2) for receiving the flat cable, a third insulator (3) disposed so as to confront the second insulator via the flat cable, and a clamp (7) interposed between the flat cable and the third insulator. When the cable-side insulator is mounted to the first insulator, the second and third insulators are engaged with the first insulator to approach each other so that the flat cable is sandwiched between the clamp and the second insulator. In this state, the flat cable is connected to the contacts.

8 Claims, 6 Drawing Sheets

FOREIGN PATENT DOCUMENTS

| | | |
|---|---|---|
| JP | 2117074 | 5/1990 |
| JP | 38277 | 1/1991 |
| JP | H3 45511 | 7/1991 |
| JP | H0474861 | 6/1992 |
| JP | 4184882 | 7/1997 |
| JP | 2000150030 | 5/2000 |
| JP | 2000277190 | 10/2000 |
| JP | 2000-223189 | 11/2000 |

* cited by examiner

CONNECTOR FOR CONNECTING A FLAT CABLE AND FOR SECURELY RETAINING THE SAME

CROSS REFERENCE TO RELATED APPLICATIONS

Applicants claim priority under 35 U.S.C. §365 of PCT/JP01/08363 filed on Sep. 26, 2001. The international application under PCT article 21(2) was not published in English.

TECHNICAL FIELD

The present invention relates to a connector used for connecting a flat cable and, in particular, relates to a structure for retaining the flat cable by the connector.

BACKGROUND ART

A connector used for connecting a flat cable is disclosed in, for example, Japanese Patent Publication (JP-B) No. H3-45511. This connector comprises a contact-side insulator retaining conductive contacts, and a cable-side insulator retaining a flat cable. The cable-side insulator is attachable/detachable relative to the contact-side insulator. When the cable-side insulator is attached to the contact-side insulator, wires of the flat cable are brought into pressure contact with the contacts. In this manner, the flat cable is connected to the connector.

In the connector of this type, it is necessary that the contacts and the flat cable are securely fixed/retained relative to the contact-side insulator and the cable-side insulator, respectively. The contacts can be retained relatively easily by providing mutual engagement structures between the contact-side insulator and the contacts. For example, by optionally contriving a shape of contacts, it is possible to engage the contacts with the contact-side insulator.

On the other hand, since the flat cable has a standardized simple shape as is well known, it is relatively difficult to retain it relative to the cable-side insulator. Movement of the flat cable relative to the cable-side insulator impedes the pressure-contact contention between the wires of the flat cable and the contacts, and thus should be avoided. To this end, for example, an attempt has been made to stick a flat cable onto a cable-side insulator using adhesives, or to form a curved portion on a flat cable in advance and engage a cable-side insulator with the curved portion.

According to those conventional techniques, however, the retention of the flat cable relative to the cable-side insulator is insufficient. Further, complicated facilities are required for automating assembly of the connector, which thus raises a problem also in terms of economics.

It is therefore an object of the present invention to provide a connector for a flat cable, which can securely retain the flat cable and economically cope with automation of assembly.

DISCLOSURE OF THE INVENTION

According to the present invention, there is obtained a connector including conductive contacts, a first insulator retaining the contacts, and a cable-side insulator, attachable/detachable relative to the first insulator, for retaining a flat cable, wherein when the cable-side insulator is mounted to the first insulator, the flat cable is connected to the contacts, the connector characterized in that the cable-side insulator comprises a second insulator for receiving the flat cable, a third insulator disposed so as to confront the second insulator via the flat cable, and a clamp interposed between the flat cable and the third insulator and, when the cable-side insulator is mounted to the first insulator, the second and third insulators are engaged with the first insulator to approach each other so that the flat cable is sandwiched between the clamp and the second insulator.

The third insulator may comprise a rib that pushes the clamp toward the flat cable.

The first insulator may have a guide groove for guiding the cable-side insulator to be attached/detached, and the second and third insulators may have convex portions, respectively, which are inserted into the guide groove.

The second insulator may have a concave portion confronting the clamp, and the flat cable may be pushed into the concave portion by the clamp.

The flat cable may comprise a plurality of cable elements, and the second insulator and the clamp may have a function of conjointly arraying the cable elements.

The third insulator may be an integral body.

The third insulator may comprise an additional insulator having the same shape and size as the second insulator, and an additional clamp interposed between the additional insulator and the clamp and, when the cable-side insulator is mounted to the first insulator, the additional insulator along with the second insulator may be engaged with the first insulator to cause the additional clamp to approach the second insulator so that the foregoing clamp may be pushed toward the second insulator by the additional clamp.

The additional insulator may directly contact with the additional clamp.

Additional conductive contacts retained by the first insulator and connected with an additional flat cable may be included, and the additional flat cable may be sandwiched between the additional insulator and the additional clamp.

Further, according to the present invention, there is obtained a flat cable connector capable of connecting one or two flat cables based on selection thereof, the flat cable connector characterized in that the connector comprises contacts to be connected with wires of the flat cable, a first insulator retaining the contacts, a second insulator for arraying the wires of the flat cable and formed with a concave portion for receiving the flat cable, a clamp for sandwiching the flat cable conjointly with the second insulator, and a third insulator formed with a rib to be brought into contact with the clamp and, when connecting the two flat cables, a plurality of the second insulators, two in number, and a plurality of the clamps, two in number, are used such that the two clamps are caused to confront each other, and the first insulator and the two second insulators are fixed together, and when connecting the one flat cable, the one second insulator, the one clamp, and the third insulator are used such that the clamp and the rib of the third insulator are brought into contact with each other, and the first insulator, the second insulator, and the third insulator are fixed together.

The flat cable may be formed with a generally crank-shaped convex portion, and the convex portion may be received in the concave portion of the second insulator.

BEST MODE FOR EMBODYING THE INVENTION

Figure 1:
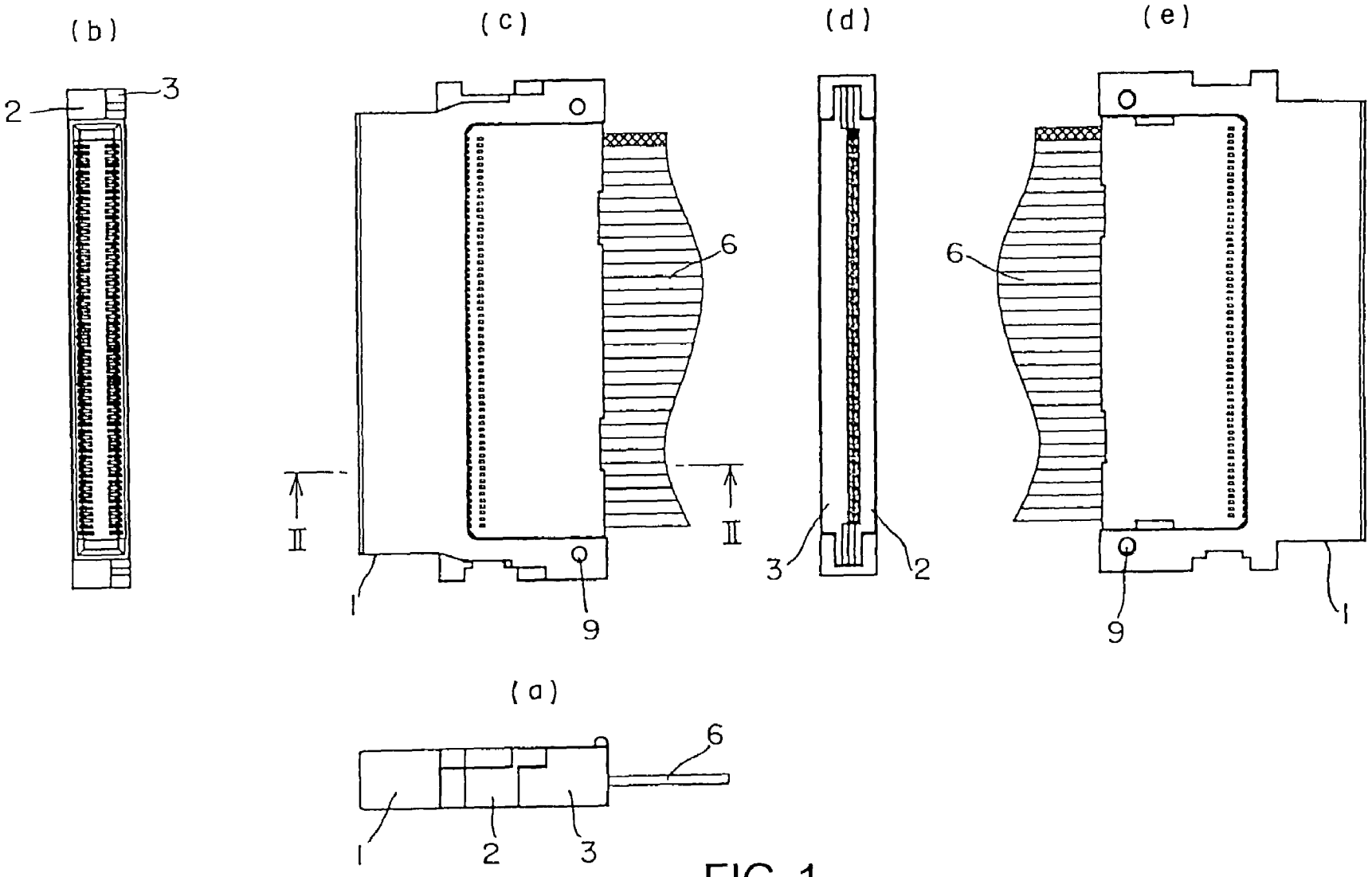
FIG. 1 shows a connector according to a first embodiment of the present invention, wherein (a) shows a bottom view, (b) shows a left side view (a diagram seen from a fitting side with a counterpart connector), (c) shows a front view, (d) shows a right side view, and (e) shows a rear view, respectively.
Figure 2:
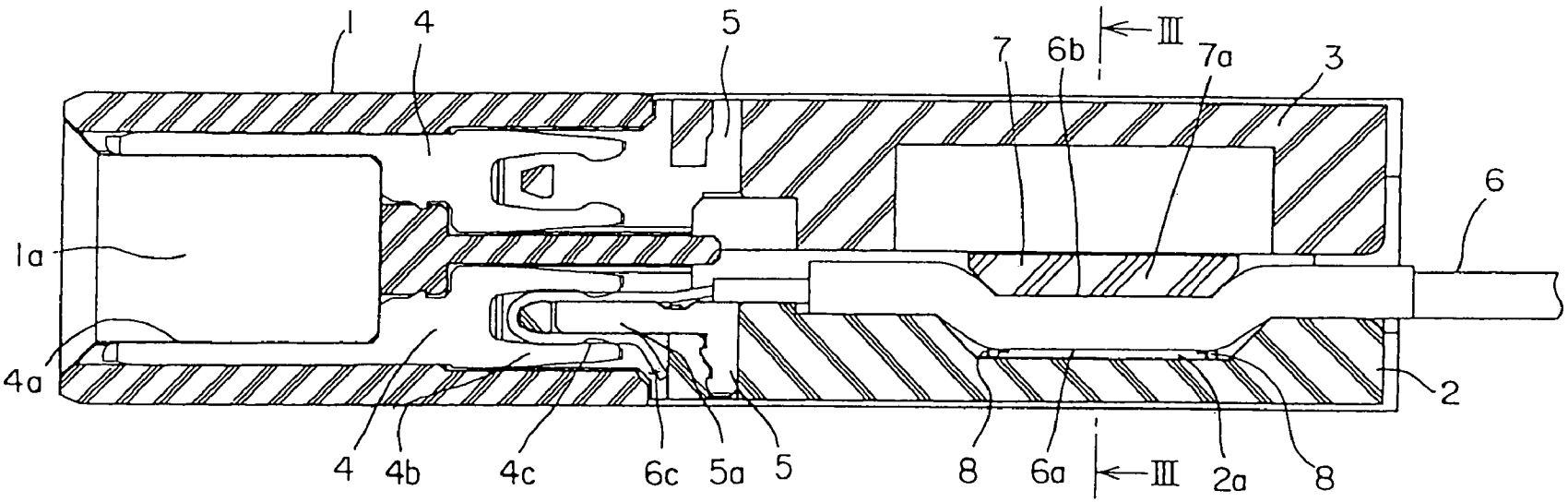
FIG. 2 is a sectional view taken along line II—II in FIG. 1(*c*).
Figure 3:
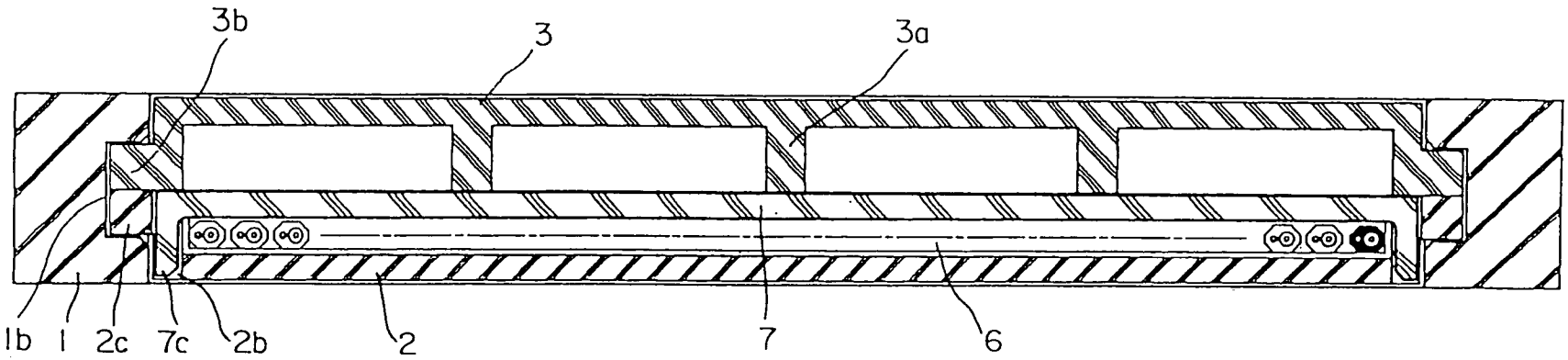
FIG. 3 is a sectional view taken along line III—III in FIG. 2.

Referring to FIGS. 1 to 3, description will be made of a connector according to a first embodiment of the present invention.

The connector of FIGS. 1 to 3 is used for connecting one flat cable 6 such as a flat ribbon cable, and comprises a first insulator 1, a second insulator 2, and a third insulator 3. In FIGS. 1(*a*) and 2, the first insulator 1 is disposed on the left side, the second insulator 2 is disposed roughly on the lower right side, and the third insulator 3 is disposed roughly on the upper right side. These insulators 1, 2, and 3 are fitted together according to a later-described structure to form an insulator portion of the connector.

The first insulator 1 fixedly retains first conductive contacts 4 divided into an upper side and a lower side and confronting each other in a vertical direction. The first contacts 4 are arrayed in large numbers on the upper side and the lower side, respectively.

Each of the first contacts 4 comprises a contact portion 4*a* for obtaining electrical connection to a counterpart connector, and a generally U-shaped tuning fork portion 4*b*. Inside the tuning fork portion 4*b*, connecting portions 4*c* are projectingly formed. The contact portions 4*a* of the first contacts 4 are arranged in an opening portion 1*a* of the first insulator 1 so as to confront each other in the vertical direction. The first insulator 1 forms a contact-side insulator.

The second insulator 2 fixedly retains second conductive contacts 5. The second contacts 5 are arrayed corresponding to the first contacts 4 on the lower side. The second insulator 2 is formed with a concave portion 2*a* having a generally trapezoidal shape in section and confronting the third insulator 3. The concave portion 2*a* is formed with two confronting portions 8.

The flat cable 6 is disposed between the second and third insulators 2 and 3. Thereupon, a generally crank-shaped portion defined by a convex portion 6*a* and a concave portion 6*b* formed in the flat cable 6 is disposed in the concave portion 2*a* of the second insulator 2.

The connector of FIGS. 1 to 3 further comprises an insulating clamp 7 interposed between the third insulator 3 and the flat cable 6. The clamp 7 has a portion 7*a* having a generally trapezoidal shape in section and confronting the concave portion 2*a* of the second insulator 2. The generally crank-shaped portion of the flat cable 6 is sandwiched between the portion 7*a* having the generally trapezoidal shape in section and the confronting portions 8. The second and third insulators 2 and 3 conjointly form a cable-side insulator.

Projecting portions 7*c* are formed on both left and right sides of the clamp 7. Holes 2*b* are formed at both left and right side portions of the second insulator 2. Rails 2*c* are formed on both left and right side surfaces of the second insulator 2. The third insulator 3 is formed with several ribs 3*a*. Rails 3*b* are formed on both left and right side surfaces of the third insulator 3. The first insulator 1 is formed with grooves 1*b*. Incidentally, wires 6*c* are each bent into a shape approximate to a predetermined U-shape in advance.

The projecting portions 7*c* of the clamp 7 are inserted into the holes 2*b* of the second insulator 2 in the state where the flat cable 6 is sandwiched as described above. The ribs 3*a* of the third insulator 3 and the rails 3*b* of the third insulator 3 are mounted on an upper surface of the clamp 7 and upper surfaces of the rails 2*c* of the second insulator 2.

Further, each rail 2*c* of the second insulator 2 and each rail 3*b* of the third insulator 3 are fitted into the groove 1*b* of the first insulator 1, then the first insulator 1 is slided relative to the second and third insulators 2 and 3. Then, by fitting between the rails 2*c* and 3*b* and the grooves 1*b*, the second and third insulators 2 and 3 are engaged with the first insulator 1 in the vertical direction so as to approach each other. As a result, the flat cable 6 is firmly sandwiched between the second insulator 2 and the clamp 7.

Further, when the first insulator 1 is slided relative to the second and third insulators 2 and 3, the wires 6*c* at the tip of the flat cable 6 are each sandwiched between the tuning fork portion 4*b* and a tip portion 5*a* of the second contact 5 so as to be reformed into the predetermined U-shape. As a result, the wires 6*c* of the flat cable 6 and the connecting portions 4*c* of the first contacts 4 suitably contact with each other to be electrically connected. Incidentally, as shown in FIG. 1, the first insulator 1, the second insulator 2, and the third insulator 3 are fixed together by inserting anti-release pins 9 into through holes that are formed at upper and lower two portions, respectively.

In FIG. 2, when the flat cable 6 is pulled rightward, the clamp 7 is pushed by the concave portion 6*b* of the flat cable 6 so as to attempt to move upward. However, as shown in FIG. 3, the several ribs 3*a* of the third insulator 3 prevent upward movement (rise) of the clamp 7. Therefore, the flat cable 6 is firmly retained by the connector so that pulling-out thereof is prevented.

Figure 4:
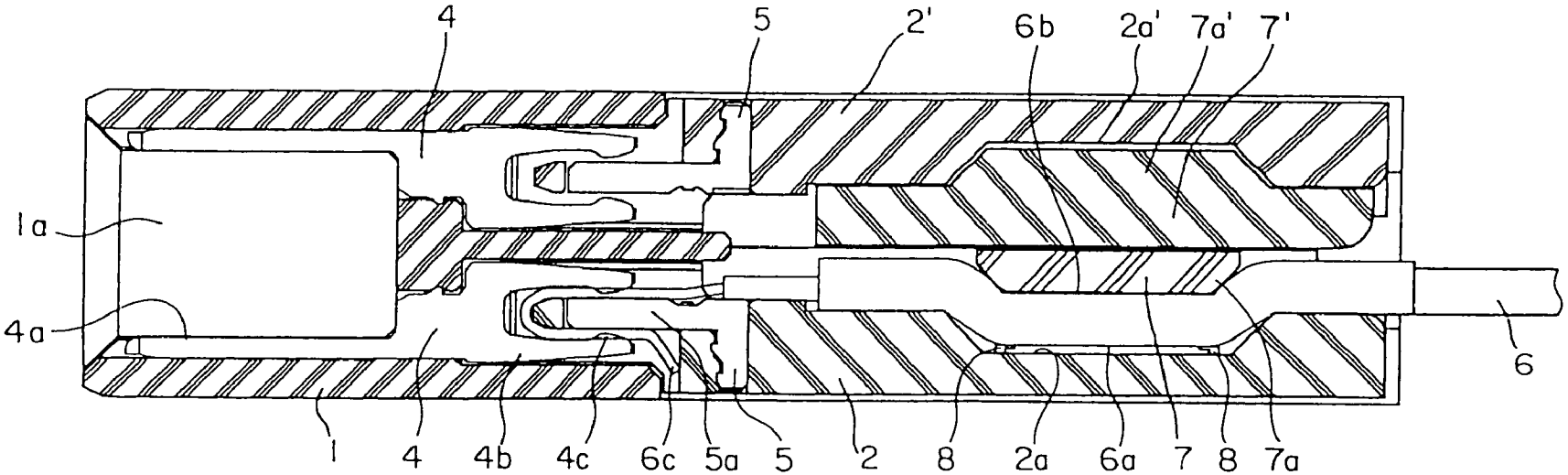
FIG. 4 is a sectional view, like FIG. 2, of a connector according to a second embodiment of the present invention.

Referring to FIG. 4, description will be made of a connector according to a second embodiment of the present invention. Like portions are assigned the same reference symbols so that description thereof may be omitted. Those portions of which description is omitted have the same structures as the connector of FIGS. 1 to 3.

The connector of FIG. 4 employs, instead of the third insulator 3 in the connector of FIGS. 1 to 3, an additional insulator 2' having the same shape and size as the second insulator 2, and an insulating additional clamp 7', as a filling member, interposed between the additional insulator 2' and the clamp 7. The additional clamp 7' has a portion 7*a'* having a generally trapezoidal shape in section and fitted in a concave portion 2*a'* of the additional insulator 2', and is formed sufficiently larger than the concave portion 2*a* of the second insulator 2.

When the second insulator 2 and the additional insulator 2' are mounted to the first insulator 1, the additional insulator 2' along with the second insulator 2 is engaged with the first insulator 1 in the vertical direction to cause the additional clamp 7' to approach the second insulator 2, according to the structure like the connector of FIGS. 1 to 3. Consequently, the foregoing clamp 7 is pushed toward the second insulator 2 by the additional clamp 7'. In this event, the additional insulator 2' directly contacts with the additional clamp 7'. As a result, the flat cable 6 is firmly sandwiched between the second insulator 2 and the clamp 7.

Figure 5:
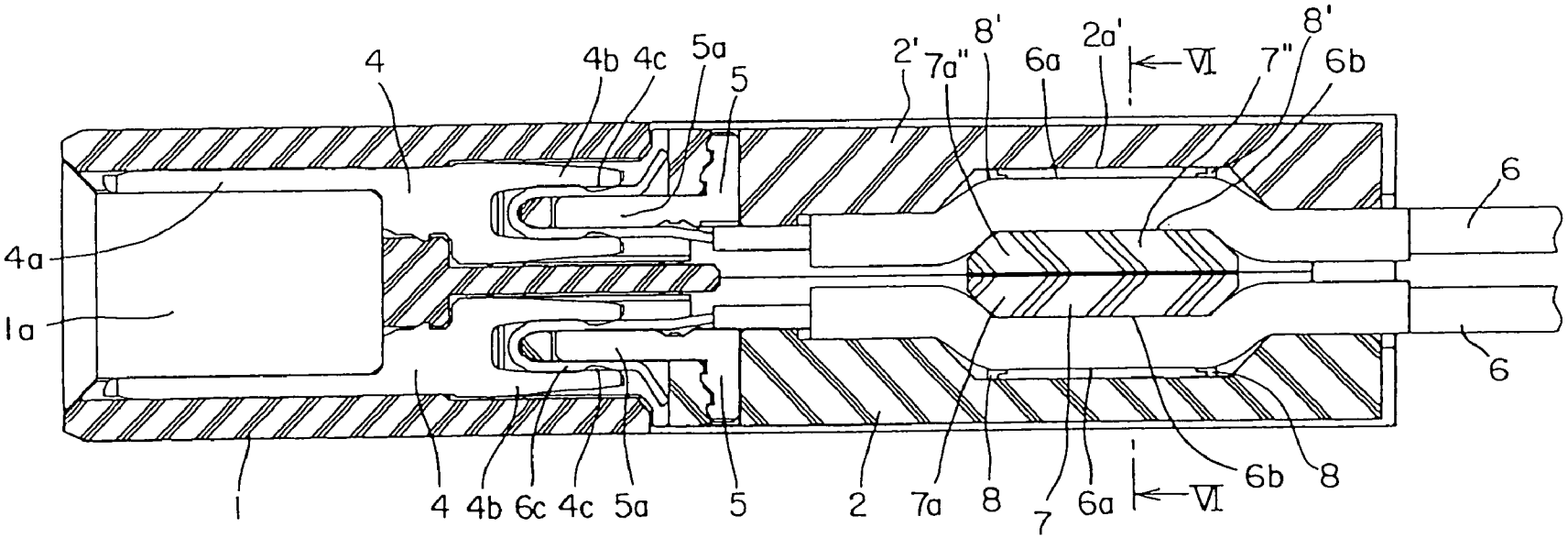
FIG. 5 is a sectional view, like FIG. 2, of a connector according to a third embodiment of the present invention.
Figure 6:
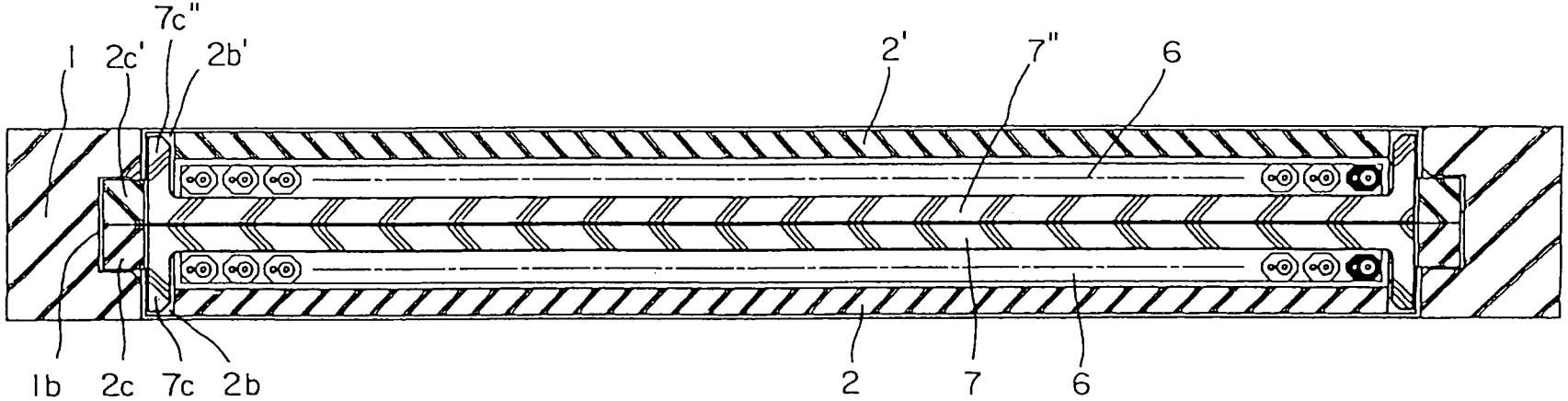
FIG. 6 is a sectional view taken along line VI—VI in FIG. 5.

Referring to FIGS. 5 and 6, description will be made of a connector according to a third embodiment of the present invention. Like portions are assigned the same reference symbols so that description thereof may be omitted. Those portions of which description is omitted have the same structures as the connector of FIGS. 1 to 3.

The connector of FIGS. 5 and 6 is used when connecting two flat cables 6 one over the other. In this case, instead of the additional clamp 7' in the connector of FIG. 4, use is made of an insulating additional clamp 7" having the same shape and size as the clamp 7 in the connector of FIGS. 1 to 3. That is, use is made of two insulators and two clamps that are the same as the second insulator 2 and the clamp 7 in the connector of FIGS. 1 to 3. Therefore, the additional clamp 7" also has a portion 7*a*" having a generally trapezoidal shape in section and fitted in a concave portion 2*a*' of an additional insulator 2'.

The additional insulator 2' also fixedly retains second contacts 5. The second contacts 5 of the additional insulator 2' are arrayed corresponding to the first contacts 4 on the upper side. The additional insulator 2' is formed with the concave portion 2*a*' having a generally trapezoidal shape in section. The concave portion 2*a*' is formed with confronting portions 8'.

Projecting portions 7*c*" are formed on both left and right sides of the additional clamp 7". Holes 2*b*' are formed at both left and right side portions of the additional insulator 2'. Rails 2*c*' are formed on both left and right side surfaces of the additional insulator 2'.

The flat cable is disposed between the second insulator 2 and the clamp 7 like in the connector of FIG. 4, and besides, the flat cable 6 is disposed also between the additional insulator 2' and the additional clamp 7". Thereupon, a generally crank-shaped portion defined by a convex portion 6*a* and a concave portion 6*b* formed in the flat cable 6 is disposed in the concave portion 2*a*' of the additional insulator 2'.

When the second insulator 2 and the additional insulator 2' are mounted to the first insulator 1 following fitting between the rails 2*c* and 2*c*' and the grooves 1*b*, the additional insulator 2' along with the second insulator 2 is engaged with the first insulator 1 in the vertical direction to approach each other, according to the structure like the connector of FIGS. 1 to 3. As a result, the flat cable 6 is firmly sandwiched between the second insulator 2 and the clamp 7, and besides, the flat cable 6 is firmly sandwiched also between the additional insulator 2' and the additional clamp 7".

Incidentally, when connecting one flat cable in the connector of FIGS. 5 and 6, the additional clamp 7" may be replaced with the additional clamp 7' in the connector of FIG. 4, or the additional insulator 2' and the additional clamp 7" may be replaced with the third insulator 3 in the connector of FIGS. 1 to 3. In this manner, it is possible to easily carry out connection of one flat cable or connection of two flat cables by exchanging the components.

INDUSTRIAL APPLICABILITY

The connector for a flat cable of the present invention is suitable as a connection device for a flat cable used in a computer, a portable telephone, or the like.

The invention claimed is:

1. A connector including conductive contacts, a first insulator retaining said contacts, and a cable-side insulator, attachable/detachable relative to said first insulator, for retaining a flat cable, wherein when said cable-side insulator is mounted to said first insulator, said flat cable is connected to said contacts, said connector characterized in that said cable-side insulator comprises a second insulator for receiving said flat cable, a third insulator disposed so as to confront said second insulator via said flat cable, and a clamp interposed between said flat cable and said third insulator and, when said cable-side insulator is mounted to said first insulator, said second and third insulators are engaged with said first insulator to approach each other so that said flat cable is sandwiched between said clamp and said second insulator, and said third insulator comprising a rib that pushes said clamp toward said flat cable.

2. A connector according to claim 1, wherein said first insulator has a guide groove for guiding said cable-side insulator to be attached/detached, and said second and third insulators have convex portions, respectively, which are inserted into said guide groove.

3. A connector according to claim 1, wherein said second insulator has a concave portion confronting said clamp, and said flat cable is pushed into said concave portion by said clamp.

4. A connector according to claim 1, wherein said flat cable comprises a plurality of cable elements, and said second insulator and said clamp have a function of conjointly arraying said cable elements.

5. A connector according to claim 1, wherein said third insulator is an integral body.

6. A connector according to claim 1, wherein said third insulator comprises an additional insulator having the same shape and size as said second insulator, and an additional clamp interposed between said additional insulator and said clamp and, when said cable-side insulator is mounted to said first insulator, said additional insulator along with said second insulator is engaged with said first insulator to cause said additional clamp to approach said second insulator so that the foregoing clamp is pushed toward said second insulator by said additional clamp.

7. A connector according to claim 6, wherein said additional insulator directly contacts with said additional clamp.

8. A connector according to claim 6, further comprising additional conductive contacts retained by said first insulator and connected with an additional flat cable, wherein said additional flat cable is sandwiched between said additional insulator and said additional clamp.

* * * * *